US008464561B2

(12) United States Patent
Brinkmann

(10) Patent No.: US 8,464,561 B2
(45) Date of Patent: Jun. 18, 2013

(54) FRONT-LOADING DRUM-TYPE WASHING MACHINE HAVING A LAUNDRY DEFLECTOR

(75) Inventor: Martin Brinkmann, Rietberg (DE)

(73) Assignee: Miele & Cie. KG, Guetersloh (DE)

( * ) Notice: Subject to any disclaimer, the term of this patent is extended or adjusted under 35 U.S.C. 154(b) by 1191 days.

(21) Appl. No.: 12/354,079

(22) Filed: Jan. 15, 2009

(65) Prior Publication Data

US 2009/0178445 A1 Jul. 16, 2009

(30) Foreign Application Priority Data

Jan. 15, 2008 (DE) ..... 10 2008 004 524

(51) Int. Cl.
*D06F 37/08* (2006.01)

(52) U.S. Cl.
USPC ..... 68/23 A; 68/3 R; 68/24

(58) Field of Classification Search
USPC ..... 68/3 R, 23 A, 24, 196
See application file for complete search history.

(56) References Cited

U.S. PATENT DOCUMENTS

| | | | | |
|---|---|---|---|---|
| 5,791,167 | A * | 8/1998 | Wyatt et al. | 68/134 |
| 6,351,974 | B1 * | 3/2002 | Lyu et al. | 68/148 |
| 7,263,863 | B2 * | 9/2007 | Brinkmann et al. | 68/24 |
| 7,263,864 | B2 * | 9/2007 | Lyu et al. | 68/148 |
| 2004/0088881 | A1 * | 5/2004 | Buss et al. | 34/601 |
| 2005/0126231 | A1 * | 6/2005 | Brinkmann et al. | 68/24 |
| 2007/0044521 | A1 | 3/2007 | Choi et al. | |
| 2007/0295037 | A1 | 12/2007 | Blomberg et al. | |

FOREIGN PATENT DOCUMENTS

| | | |
|---|---|---|
| DE | 8008183 | 8/1980 |
| DE | 202004011470 | 9/2004 |
| DE | 102004043671 | 3/2006 |
| WO | 0212612 | 2/2002 |

OTHER PUBLICATIONS

European Search Report for European Application Serial No. 09 00 0203, dated Apr. 23, 2009.

* cited by examiner

*Primary Examiner* — Michael Barr
*Assistant Examiner* — Benjamin L Osterhout
(74) *Attorney, Agent, or Firm* — Leydig, Voit & Mayer, Ltd.

(57) ABSTRACT

A front-loading drum-type washing machine with a housing having a front wall and a housing wall opening disposed in the front wall. A suds container is disposed in the housing, the suds container having a suds container opening. A drum is rotatably mounted in the suds container. the drum has a drum opening with an edge. A bellows seal is disposed between the suds container and the housing wall opening. A laundry deflector is disposed in an upper area of the suds container opening, the laundry deflector being directed toward the drum and extending over the drum opening edge so as to form a gap with the drum opening edge. The laundry deflector is configured such that the extent to which it extends and a corresponding dimension of the gap is variable. The variable gap dimension is controllable and adjustable as a function of a speed of the drum.

18 Claims, 5 Drawing Sheets

FRONT-LOADING DRUM-TYPE WASHING MACHINE HAVING A LAUNDRY DEFLECTOR

CROSS REFERENCE TO RELATED APPLICATIONS

Priority is claimed to German Patent Application No. DE 10 2008 004 524.1, filed Jan. 15, 2008, the entire disclosure of which is incorporated by reference herein.

FIELD

The present invention relates to a front-loading drum-type washing machine including a drum rotatably mounted in a suds container with a bellows seal disposed between the suds container and a housing wall and a laundry deflector provided in the upper area of the suds container opening that is directed towards the drum.

BACKGROUND

In front-loading washing machines, the door opening is made relatively large, which makes it easier for the user to load and unload the drum. This requires, inter alia, a large opening in the front of the drum. Since the drum diameter is defined by the standardized housing width, the width of the front drum end wall, i.e., of the annular ring that acts as the front drum end wall, is necessarily reduced because of the enlarged opening. As a consequence of this reduction, laundry is more likely to be pushed over the edge of the front drum end wall as the drum rotates, and then get jammed between the door glass and the bellows seal. Therefore WO 02/12612 A1 describes a laundry deflector in the region of the bellows seal and, more specifically, in the region of the twelve o'clock position. The laundry deflector is formed on the door sealing ring such that it is directed toward the drum and serves to return the laundry back into the rotating drum. For automatic washing machines having a large drum volume, it is necessary to reinforce the laundry deflector because of the high weight of the laundry. In another laundry deflector, for example, from German document DE 10 2004 043 671 A1, a channel system is described that supplies liquid to the region of the laundry deflector so as to reduce the risk of damage occurring to the laundry.

However, in all these embodiments the laundry deflectors require a minimum distance to be maintained from the drum, so as to avoid contact with the drum; i.e., to avoid contact caused by an excursion of the drum. This significantly limits the function of the laundry deflector. Moreover, the function of the laundry deflector could be improved if it could be made larger. However, this is not possible because the laundry deflector presents an obstacle during loading, and is therefore perceived to be disturbing. Moreover, if the laundry deflector extends along a large circumferential portion of the drum opening, or if it extends too far into the opening, it will cause dry laundry to rub against it during the wetting phase.

Moreover, with some laundry deflectors, corners of laundry items enter into the gap with respect to the drum edge opening and have a tendency not to be drawn out anymore because of the minimum distance from the drum opening edge in a radial direction. They are entrained by the drum edge and remain in the gap between the drum edge and the bellows seal.

SUMMARY

An aspect of the present invention is to provide a front-loading drum-type washing machine of the type with the property that if corners of laundry items enter into the gap between the drum edge opening and the bellows seal, such corners will be reliably drawn out therefrom.

In an embodiment, the present invention provides a front-loading drum-type washing machine with a housing having a front wall and a housing wall opening disposed in the front wall. A suds container is disposed in the housing, the suds container having a suds container opening. A drum is rotatably mounted in the suds container. The drum has a drum opening with an edge. A bellows seal is disposed between the suds container and the housing wall opening. A laundry deflector is disposed in an upper area of the suds container opening, the laundry deflector being directed toward the drum and extending over the drum opening edge so as to form a gap with the drum opening edge. The laundry deflector is configured such that the extent to which it extends and a corresponding dimension of the gap is variable. The variable gap dimension is controllable and adjustable as a function of a speed of the drum.

BRIEF DESCRIPTION OF THE DRAWINGS

An exemplary embodiment of the present invention will be explained in more detail with reference to the figures, in which.

DETAILED DESCRIPTION

Figure 1:
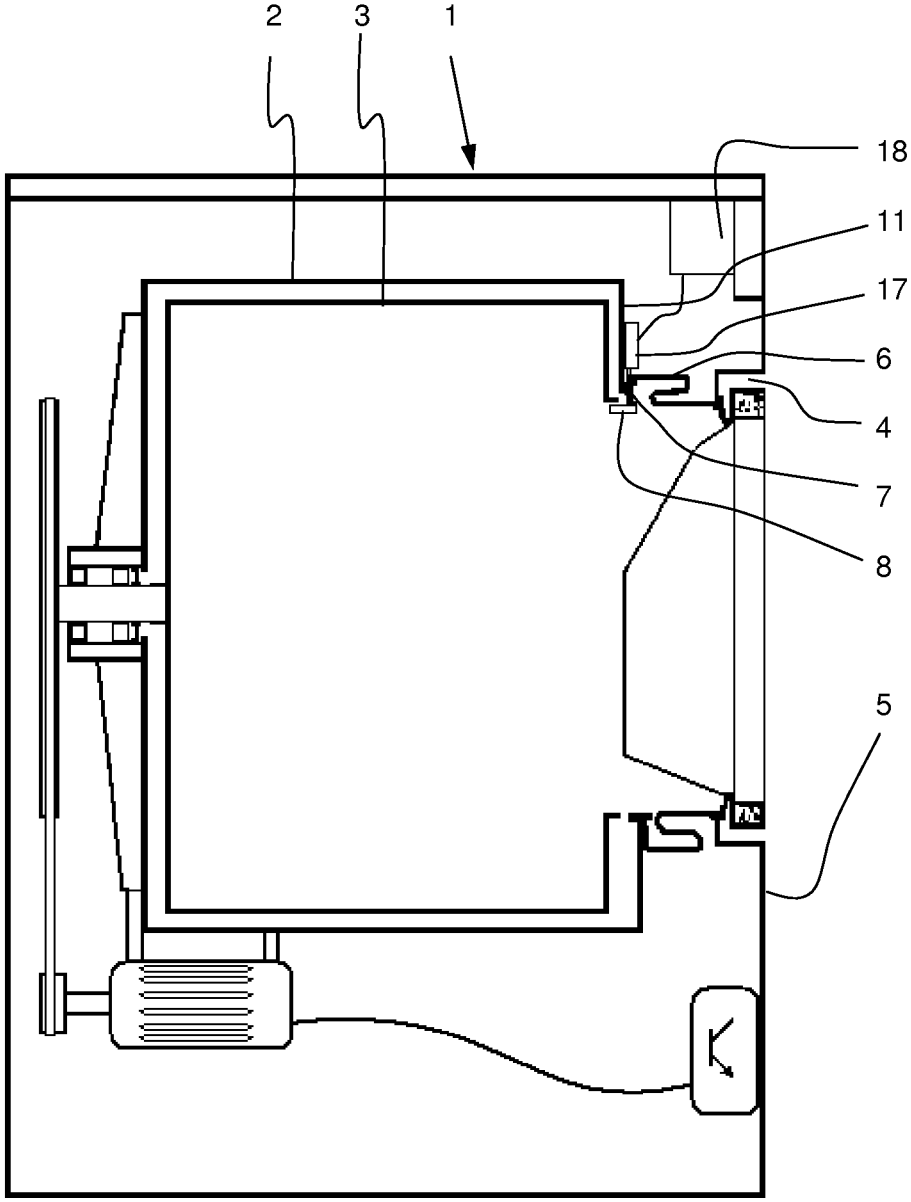
FIG. 1 is a cross-sectional side view of a front-loading drum-type washing machine.

In an embodiment of the present invention the laundry is treated gently, and especially so in machines having very large loading openings, the gap setting is taken into account according to the particular operating state of the machine. Thus, when the drum rotates at low speeds, e.g., at less than 400 RPM, at which the excursion of the drum is small, the laundry deflector may be moved quite close to the edge of the drum opening without contacting the drum. The small gap ensures that laundry will not be pulled in and get jammed between the laundry deflector and the drum opening edge. In a speed range of less than 80 RPM, the laundry is still being distributed within the drum, while it is pressed against the wall of the drum as the speed increases. Once the laundry is pressed against the cylindrical drum wall and there are no more laundry items in the area of the drum opening, i.e., of the drum opening edge, the laundry deflector is no longer needed.

For this purpose, the laundry deflector is configured to be variable in the extent to which it extends over the drum edge opening and in its gap-forming position relative to the drum edge opening, the variable gap dimension being controllable and adjustable as a function of the drum speed. To this end, the laundry deflector cooperates with an adjustment mechanism mounted to the front end wall of the suds container, said adjustment mechanism acting radially relative to the drum opening edge. The adjustment mechanism itself includes a plunger whose lower end is enclosed in an elastic portion of the laundry deflector and whose upper end cooperates with a drive unit. The drive unit is operatively connected to a controller of the washing machine. In order to provide, in particular, the portion of the laundry deflector here in a movable or elastic form, it has a hollow cavity formed in the integrally molded laundry deflector portion. In order to provide an elastic design, the inner wall of the hollow cavity is configured to be flexible and extensible, so that the laundry deflector can be retracted and extended. A guide channel for receiving the plunger is provided above the hollow cavity in the region of the bellows ring. In order to adjust the laundry deflector, the plunger performs either a reciprocating, an angular, or a pushing movement in order to thereby control the dimension of the gap with respect to the drum opening edge. The drive unit for adjusting the plunger may be an electromotive drive or an electromagnetic drive. However, it is also conceivable to use a memory metal to displace the plunger; i.e., to move the laundry deflector.

In another embodiment, the drive unit for adjusting the plunger is provided by a hydraulic or pneumatic drive. In such an embodiment, water pressure is used in conjunction with a return spring in order to move the plunger. Pneumatic actuation is advantageous if the appliance already has a compressed air system for other functions, which may be the case, for example, in commercial washing machines.

FIG. 1 shows, in a cross-sectional side view, a front-loading drum-type washing machine 1 including a drum 3 rotatably mounted in a suds container 2 a bellows seal 6 being disposed between suds container 2 and a housing wall opening 4 at front wall 5. Located in the upper area of suds container opening 7 is a laundry deflector 8 which is directed towards drum 3 or towards the interior of drum 3.

Figure 2:
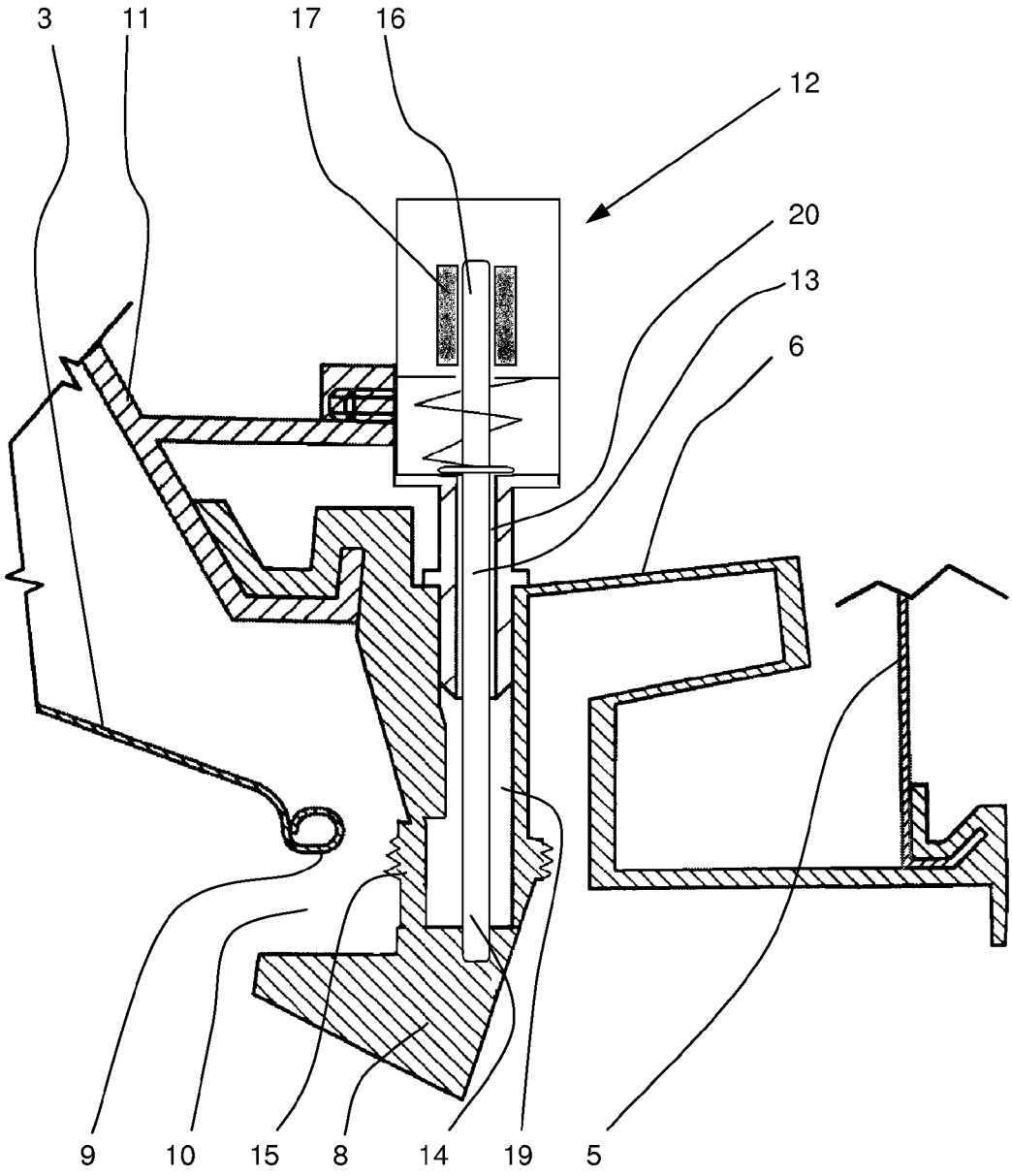
FIG. 2 is a cross-sectional, detailed side view showing the laundry deflector in the lower position.

Viewing FIGS. 1 and 2 together, it is apparent that laundry deflector 8 is configured to be variable in the extent to which it extends over drum opening edge 9 and in its gap-forming position relative to drum opening edge 9. Variable gap dimension 10 is controllable and adjustable as a function of the drum speed. To this end, laundry deflector 8 cooperates with an adjustment mechanism 12 mounted to front end wall 11 of the suds container, said adjustment mechanism acting radially relative to drum opening edge 9. Adjustment mechanism 12 includes a plunger 13 whose lower end 14 is enclosed in an elastic portion 15 of laundry deflector 8. Upper end 16 of plunger 13 cooperates with a drive unit 17. Drive unit 17, in turn, is operatively connected to a controller 18 of washing machine 1, as is indicated in FIG. 1.

Elastic portion 15 includes a hollow cavity 19 formed in molded laundry deflector 8. This hollow cavity 19 helps, in particular, to reduce the wall thickness, which makes this portion particularly elastic and at the same time impervious. A guide channel 20 for receiving plunger 13 is provided above hollow cavity 19 in the region of bellows seal ring 6. As shown in FIG. 2, plunger 13 performs a reciprocating movement to thereby control gap dimension 10.

Figure 4:
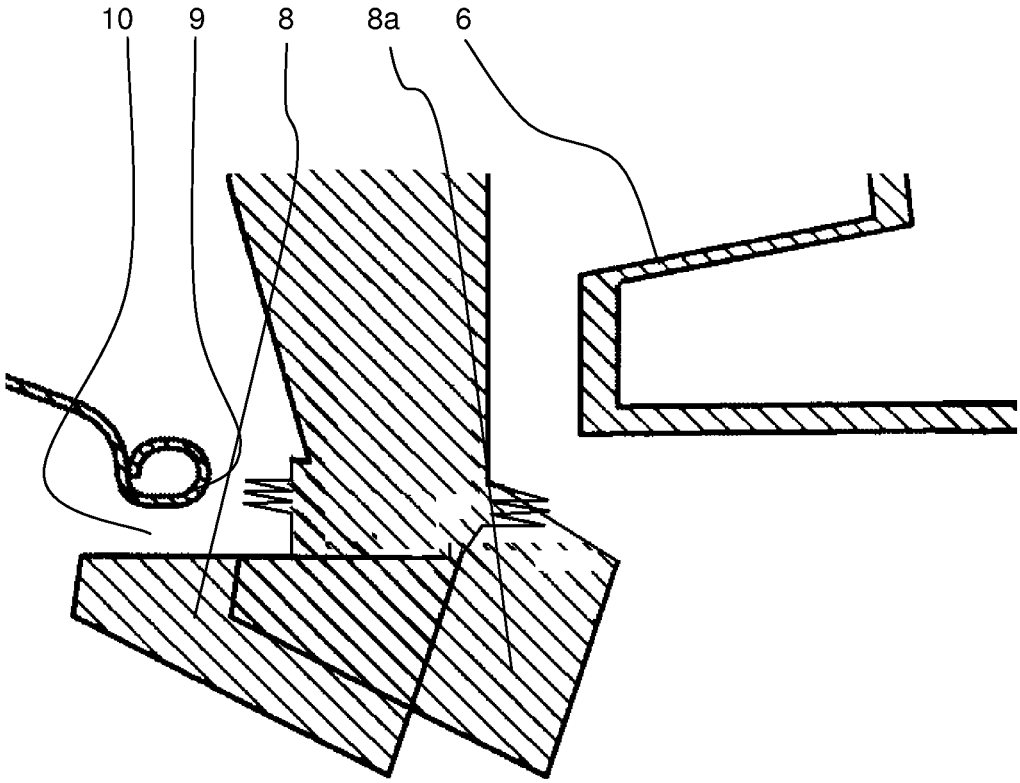
FIG. 4 is a view of another embodiment of the laundry deflector, shown in a first and second position.
Figure 5:
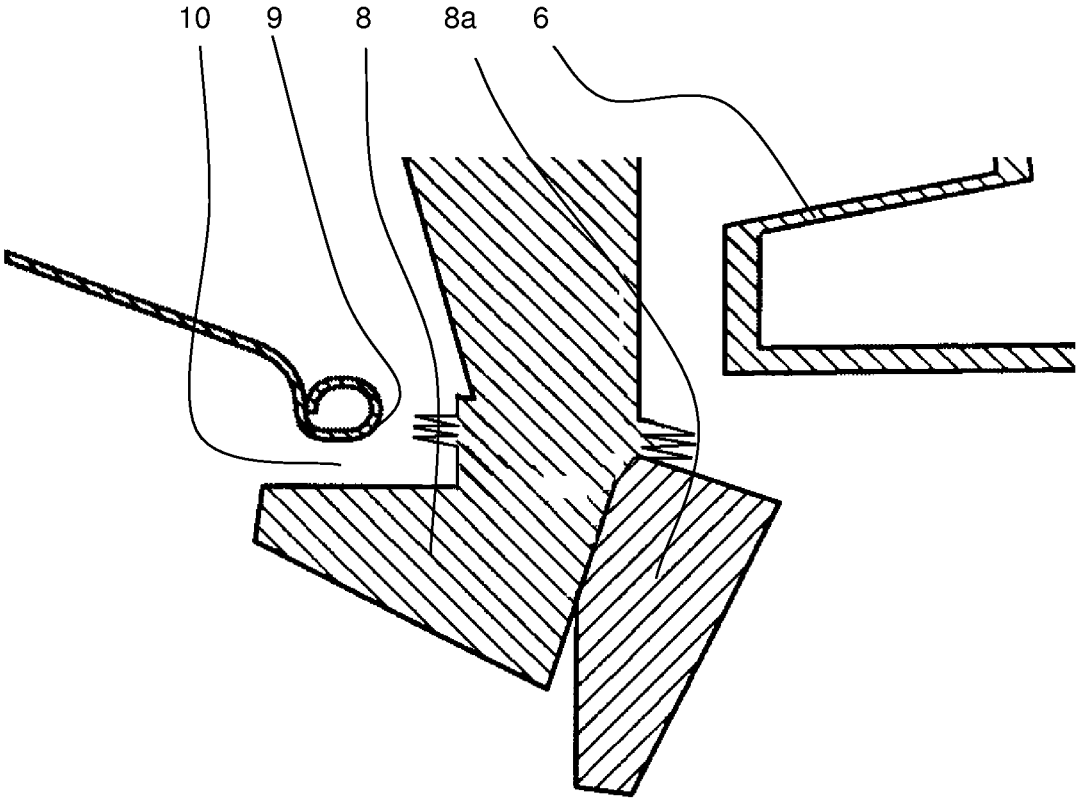
FIG. 5 is a view of yet another embodiment of the laundry deflector.

As shown in the view of FIG. 4, the plunger may initiate an angular movement in order to control gap dimension 10 in this manner. However, a kind of a pushing movement is also conceivable, such as is illustrated in FIG. 5. In that case, laundry deflector 8 is displaced axially with respect to the orientation of the drum. Reference numeral 8*a* denotes the position of laundry deflector 8 in which it is remote from drum opening edge 9.

Figure 3:
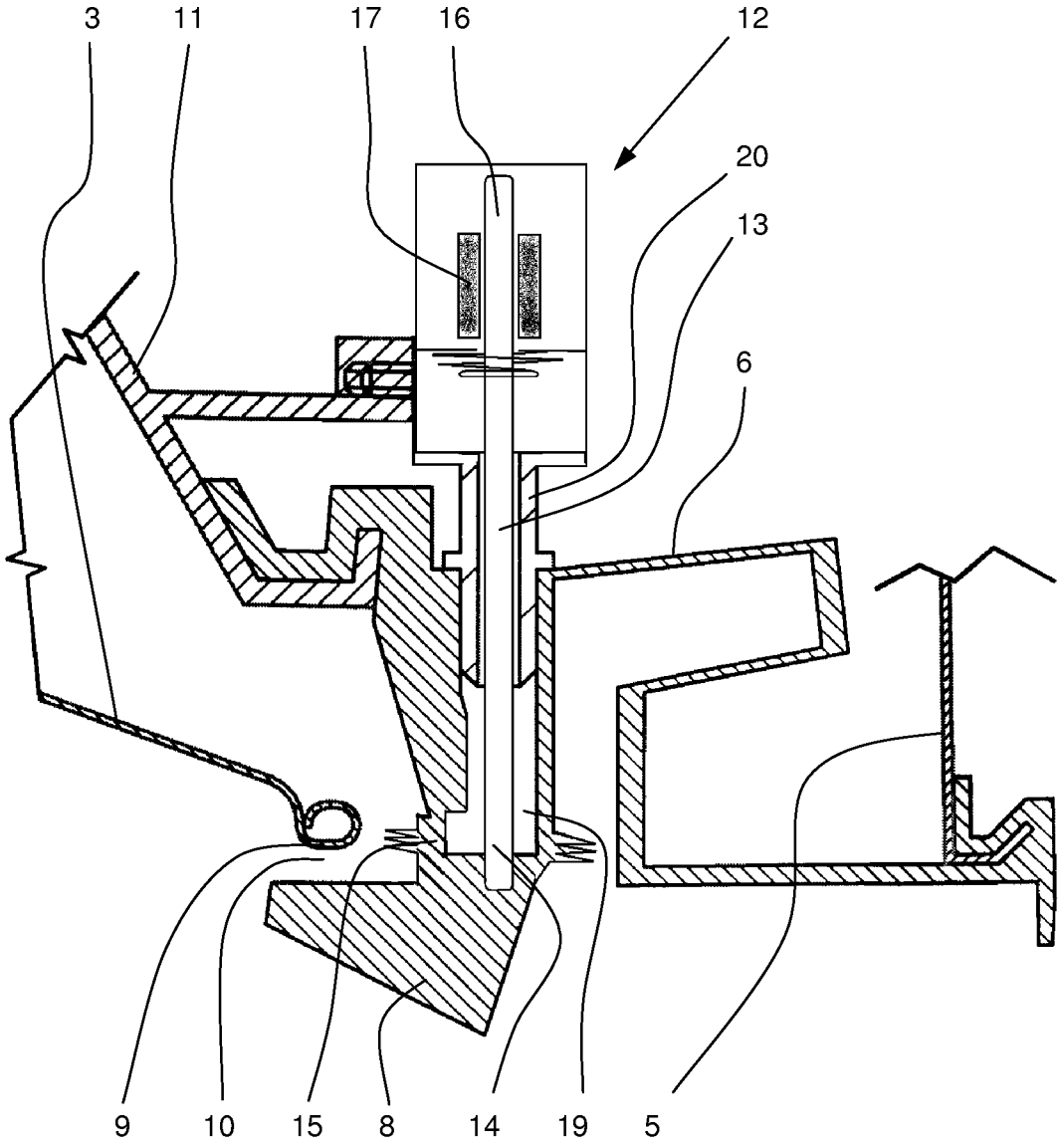
FIG. 3 is a cross-sectional, detailed side view similar to that of FIG. 2, showing the laundry deflector in the upper position.

Drive unit 17 (FIGS. 2, 3) for adjusting plunger 13 may itself be provided by an electric motor or an electromagnetic actuator, such as a solenoid. However, it is also conceivable for drive unit 17 to be in the form of a memory metal.

The present invention is not limited to the embodiments described herein; reference should be had to the appended claims.

What is claimed is:

1. A housing with a front wall and a housing wall opening disposed in the front wall; a suds container disposed in the housing, the suds container having a suds container opening; a drum rotatably mounted in the suds container, the drum having a drum opening with an edge; a bellows seal disposed between the suds container and the housing wall opening; and a laundry deflector disposed in an upper area of the suds container opening, the laundry deflector being directed toward the drum and extending over the drum opening edge so as to form a gap with the drum opening edge, the laundry deflector being configured such that the extent to which it extends and a corresponding dimension of the gap is variable, the variable gap dimension being controllable and adjustable as a function of a speed of the drum;

an adjustment mechanism disposed in the suds container, the adjustment mechanism configured to adjust the laundry deflector relative to the drum opening edge; and a drive unit, and wherein the adjustment mechanism includes a plunger with a lower end enclosed in an elastic portion of the laundry deflector and an upper end cooperating with the drive unit.

2. The front-loading drum-type washing machine as recited in claim 1, wherein the adjustment mechanism is mounted on a front end wall of the suds container.

3. The front-loading drum-type washing machine as recited in claim 1, wherein the drive unit includes at least one of an electric motor, an electromagnetic actuator and a memory metal.

4. The front-loading drum-type washing machine as recited in claim 1, wherein the drive unit includes at least one of a hydraulic drive and a pneumatic drive.

5. The front-loading drum-type washing machine as recited in claim 1 further comprising a controller, and wherein the drive unit is operatively connected to the controller.

6. The front-loading drum-type washing machine as recited in claim 5 wherein the plunger is configured to perform at least one of a reciprocating, angular and pushing movement so as to adjust the laundry deflector.

7. The front-loading drum-type washing machine as recited in claim 5, wherein the drive unit includes at least one of an electric motor, an electromagnetic actuator and a memory metal.

8. The front-loading drum-type washing machine as recited in claim 5, wherein the drive unit includes at least one of a hydraulic drive and a pneumatic drive.

9. The front-loading drum-type washing machine as recited in claim 1, wherein the elastic portion of the laundry deflector includes a hollow cavity.

10. The front-loading drum-type washing machine as recited in claim 9 wherein the plunger is configured to perform at least one of a reciprocating, angular and pushing movement so as to adjust the laundry deflector.

11. The front-loading drum-type washing machine as recited in claim 9, wherein the drive unit includes at least one of an electric motor, an electromagnetic actuator and a memory metal.

12. The front-loading drum-type washing machine as recited in claim 9, wherein the drive unit includes at least one of a hydraulic drive and a pneumatic drive.

13. The front-loading drum-type washing machine as recited in claim 9, further comprising a channel guide configured to receive the plunger, the channel guide being disposed above the hollow cavity in a vicinity of the bellows seal.

14. The front-loading drum-type washing machine as recited in claim 13 wherein the plunger is configured to perform at least one of a reciprocating, angular and pushing movement so as to adjust the laundry deflector.

15. The front-loading drum-type washing machine as recited in claim 13, wherein the drive unit includes at least one of an electric motor, an electromagnetic actuator and a memory metal.

16. The front-loading drum-type washing machine as recited in claim 13, wherein the drive unit includes at least one of a hydraulic drive and a pneumatic drive.

17. The front-loading drum-type washing machine as recited in claim 1 wherein the plunger is configured to perform at least one of a reciprocating, angular and pushing movement so as to adjust the laundry deflector.

18. The front-loading drum-type washing machine as recited in claim 17, wherein the drive unit includes at least one of a hydraulic drive and a pneumatic drive.

* * * * *